United States Patent [19]

Burton, III

[11] 4,200,336

[45] Apr. 29, 1980

[54] MEANS FOR PROVIDING GAS SEAL IN PRODUCTION LEVEL DRIFT FOR IN SITU OIL SHALE RETORT

[75] Inventor: Robert S. Burton, III, Grand Junction, Colo.

[73] Assignee: Occidental Oil Shale, Inc., Grand Junction, Colo.

[21] Appl. No.: 924,982

[22] Filed: Jul. 17, 1978

[51] Int. Cl.[2] ..... E21C 41/10

[52] U.S. Cl. ..... 299/2; 405/55

[58] Field of Search ..... 299/2; 405/53–59

[56] References Cited

U.S. PATENT DOCUMENTS

| | | | |
|---|---|---|---|
| 2,879,646 | 3/1959 | Brandt | 405/57 |
| 2,880,593 | 4/1959 | Johnson et al. | 405/53 X |
| 3,385,067 | 5/1968 | Van Eek | 405/59 |
| 3,917,346 | 11/1975 | Janssen | 299/2 X |
| 4,007,963 | 2/1977 | Ridley | 299/2 |

FOREIGN PATENT DOCUMENTS

| | | | |
|---|---|---|---|
| 1040181 | 8/1966 | United Kingdom | 405/59 |

*Primary Examiner*—Ernest R. Purser
*Attorney, Agent, or Firm*—Christie, Parker & Hale

[57] ABSTRACT

An in situ oil shale retort is formed in a subterranean formation containing oil shale. The retort contains a fragmented permeable mass of formation particles containing oil shale. During retorting, oxygen-supplying gas is introduced into an upper level of the fragmented mass for establishing a combustion zone and for advancing the combustion zone downwardly through the fragmented mass. Liquid and gaseous products, including shale oil and off gas, are withdrawn from a generally U-shaped production level drift at a lower level of the fragmented mass. Liquid in a lower portion of the U seals against the roof of the drift to provide a gas seal which inhibits passage of off gas from a first leg of the drift in communication with the retort to a second leg of the drift remote from the retort. A retaining wall in the second leg of the drift can provide lateral support for the liquid forming the gas seal, and help minimize the depth of excavation of the U-shaped drift. Shale oil and off gas can be separately withdrawn from the first leg of the drift.

32 Claims, 4 Drawing Figures

MEANS FOR PROVIDING GAS SEAL IN PRODUCTION LEVEL DRIFT FOR IN SITU OIL SHALE RETORT

BACKGROUND OF THE INVENTION

This invention relates to recovery of liquid and gaseous products from subterranean formations containing oil shale, and more particularly, to techniques for providing a gas seal in a lower production level of an in situ oil shale retort.

The presence of large deposits of oil shale in the Rocky Mountain region of the United States has given rise to extensive efforts to develop methods for recovering shale oil from kerogen in the oil shale deposits. The term "oil shale" as used in the industry is in fact a misnomer; it is neither shale, nor does it contain oil. It is a sedimentary formation comprising marlstone deposit with layers containing an organic polymer caller "kerogen" which, upon heating, decomposes to produce liquid and gaseous products. It is the formation containing kerogen that is called "oil shale" herein, and the liquid hydrocarbon product is called "shale oil".

A number of methods which have been proposed for processing oil shale involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423, 4,043,595; 4,043,596; 4,043,597; and 4,043,598, which are incorporated herein in this reference. These patents describe in situ recovery of liquid and gaseous hydrocarbon materials from a subterranean formation containing oil shale wherein such formation is fragmented by explosive expansion techniques, forming a fragmented permeable body or mass of formation particles containing oil shale within the formation, referred to herein as an in situ oil shale retort.

In forming such a fragmented mass, at least one void is excavated from formation within the retort site, leaving a remaining portion of unfragmented formation within the retort site adjacent the void. Explosive is loaded into blasting holes drilled in the remaining portion of unfragmented formation. The explosive is detonated for explosively expanding the remaining portion of unfragmented formation toward the free face of formation adjacent the void for forming a fragmented permeable mass of formation particles containing oil shale in an in situ oil shale retort.

During retorting, hot retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the fragmented mass and introducing an oxygen-supplying gaseous combustion zone feed into the fragmented mass to advance the combustion zone through the fragmented mass. In the combustion zone, oxygen in the combustion zone feed is depleted by reaction with hot carbonaceous materials to produce heat, combustion gas, and combusted oil shale. By continued introduction of the combustion zone feed into the fragmented mass, the combustion zone is advanced through the fragmented mass.

The combustion gas and the portion of the combustion zone feed that does not take part in the combustion process pass through the fragmented mass on the advancing side of the combustion zone. This heats the oil shale in a retorting zone to a temperature sufficient to produce kerogen decomposition, called retorting, in the oil shale. The kerogen decomposes into gaseous and liquid products, including gaseous and liquid hydrocarbon products, and to a residual solid carbonaceous material.

The liquid products and gaseous products are cooled by the cooler oil shale fragments in the retort on the advancing side of the retorting zone. During retorting, the liquid products and a process off gas containing gaseous products pass to a lower level of the fragmented mass. The liquid hydrocarbon products, together with water produced in or added to the retort, are collected at the bottom of the retort. An off gas also is withdrawn from the bottom of the retort. The off gas contains combustion gas, including carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

The water and shale oil can be separately withdrawn through a production level drift. The process off gas also is withdrawn through the production level drift. The off gas can contain nitrogen, hydrogen, carbon monoxide, carbon dioxide, water vapor, methane, and other hydrocarbons and sulfur compounds, such as hydrogen sulfide. Hydrogen sulfide and carbon monoxide are extremely toxic gases. For this reason, the production level drift is sealed against the passage of off gas from the portion of the drift where the gas is withdrawn, so that workers in adjacent underground workings at the production level are isolated from the off gas collected in the production level drift.

The production level drift can be sealed by a bulkhead placed across the drift. The bulkhead can comprise a steel bulkhead plate secured to a rigid framework. Concrete anchors the peripheral portion of the bulkhead and seals the bulkhead across the cross-sectional area of the drift.

The present invention provides a gas seal for a production level drift wherein the need for a bulkhead sealed across the drift can be eliminated. The invention thus can reduce this cost of forming a gas seal in a production level drift because the materials cost for the conventional bulkhead structure can be avoided, as well as the time and cost required to form the bulkhead in the drift. Gas leakage through a bulkhead is avoided and leakage problems through formation around such a bulkhead are alleviated.

SUMMARY OF THE INVENTION

This invention provides a gas seal for a production level of an in situ oil shale retort containing a fragmented permeable mass of formation particles containing oil shale. A generally U-shaped production level drift has a first leg in communication with the fragmented mass and a second leg in communication with adjacent underground workings. Sufficient liquid is maintained in a bottom portion of the U-shaped drift that the liquid in the U-shaped drift is maintained in contact with the roof of the drift to form a gas seal. The liquid forms a liquid trap which provides a gas seal for inhibiting the flow of gas from the first leg to the second leg of the drift.

In one embodiment, a retaining wall extending across only a portion of the cross-sectional area of the drift can provide lateral support for the liquid forming the gas seal. Means can be provided for adjusting the level of the liquid forming the gas seal.

DRAWINGS

The features of specific embodiments of the best modes contemplated for carrying out the invention are illustrated in the drawings, in which:

FIG. 4 is a fragmentary, semi-schematic, cross-sectional side view showing an alternate means for providing a retaining wall for laterally supporting the liquid forming the gas seal.

DETAILED DESCRIPTION

Figure 1:
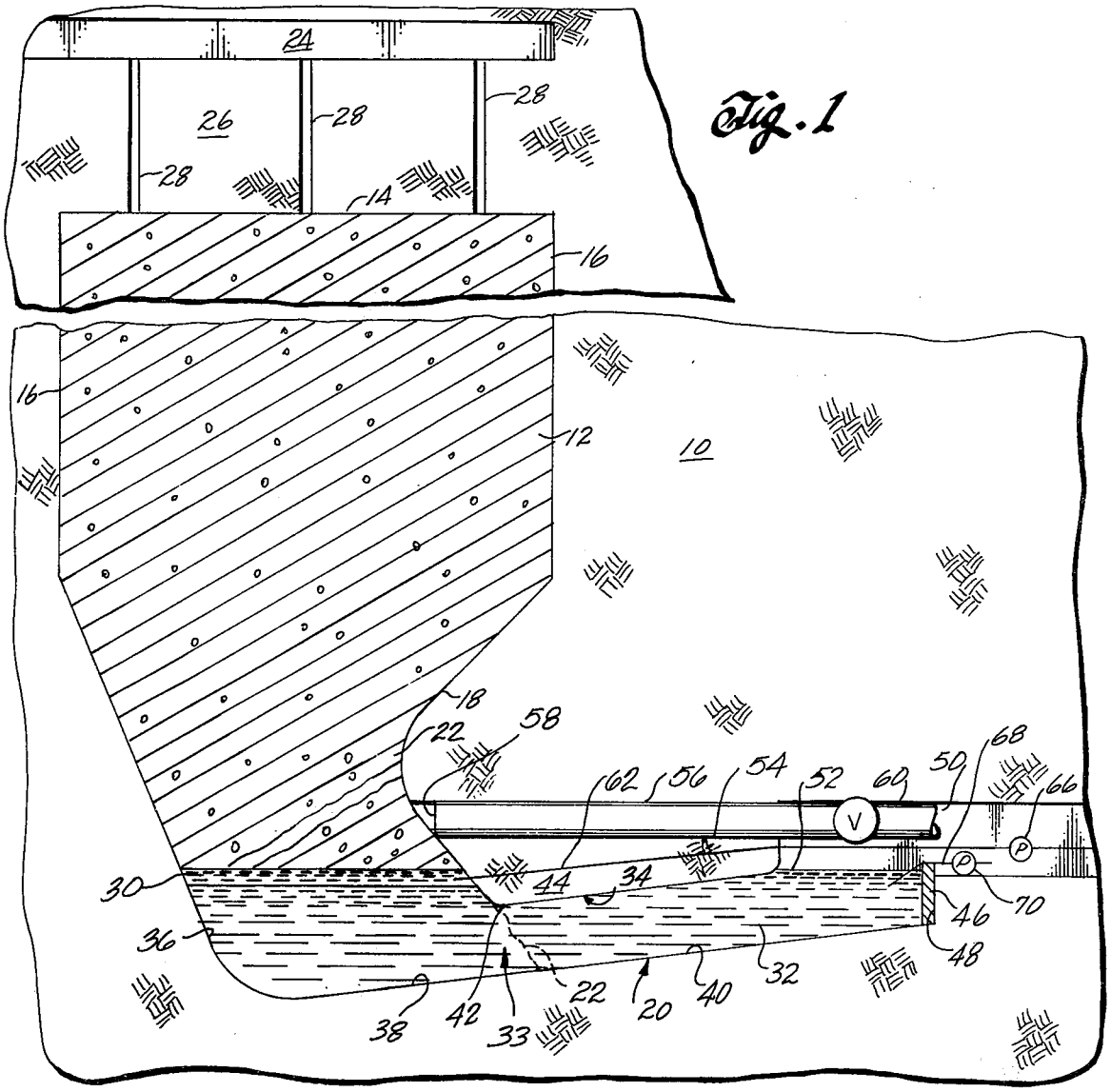
FIG. 1 is a fragmentary, semi-schematic, cross-sectional side view showing an in situ oil shale retort having a gas seal formed by a liquid trap in a production level drift according to principles of this invention.

FIG. 1 shows a semi-schematic cross-sectional side view of an in situ oil shale retort formed in a subterranean formation 10 containing oil shale. The in situ oil shale retort includes a fragmented permeable mass 12 of formation particles containing oil shale. The fragmented mass 12 can be formed by conventional explosive expansion techniques wherein at least one void is excavated from formation within the retort site, leaving a remaining portion of unfragmented formation adjacent such a void. Blasting holes (not shown) are then drilled in such remaining portion of unfragmented formation adjacent the void, and the blasting holes are loaded with explosive which is detonated for explosively expanding such remaining portion of unfragmented formation toward such a void for forming the fragmented mass 12.

The fragmented mass 12 shown in FIG. 1 is rectangular in horizontal cross-section and has a top boundary 14 and four vertically extending side boundaries 16. A lower boundary 18 of the fragmented mass can taper downwardly and inwardly from opposite sides of the fragmented mass for forming a generally funnel-shaped throat 18 at the bottom boundary of the fragmented mass.

A production level drift 20 formed according to principles of this invention provides a means for access to the lower portion of the fragmented mass 12. Before or during explosive expansion for forming the fragmented mass, formation particles 22 from the fragmented mass fall under gravity into an inside portion of the production level drift 20 at the bottom of the fragmented mass being formed. Liquid and gaseous products of combustion are collected in the production level drift 20 during retorting operations.

The in situ oil shale retort can have an open base of operation 24 excavated on an upper working level. The floor of such a base of operation 24 can be spaced above the upper boundary 14 of the fragmented mass, leaving a horizontal sill pillar 26 of unfragmented formation between the bottom of the base of operation and the top boundary 14 of the fragmented mass 12. The base of operation 24 can provide effective access to substantially the entire horizontal cross-section of the fragmented mass. Such a base of operation provides an upper level means for access for excavating operations for forming a void and/or drilling and explosive loading for explosive expanding of formation toward such a void when forming the fragmented mass 12. The base of operation 24 also facilitates introduction of oxygen-supplying gas into the top of the fragmented mass during retorting operations.

During retorting, the fragmented formation particles at top of the fragmented mass are ignited to establish a combustion zone at the top of the fragmented mass. Air or other oxygen-supplying gas can be introduced into the combustion zone from the base of opertion 24 through vertical air passages 28 drilled downwardly from the base of operation 24 through the sill pillar 26 to the top of the fragmented mass 12. Conduits can be installed in the vertical air passages 28, and gas flow control valves (not shown) in the base of operation 24 can be used for controlling the flow of oxygen-supplying gas through the respective conduits to the fragmented mass 12. Air or other oxygen-supplying gas introduced to the fragmented mass through such conduits maintains the combustion zone and advances it downwardly through the fragmented mass. Hot gas from the combustion zone flows through the fragmented mass on the advancing side of the combustion zone to a retorting zone where kerogen in the fragmented mass 12 is converted to liquid and gaseous products. As the retorting zone moves down through the fragmented mass, liquid and gaseous products are released from the fragmented formation particles. Liquid products, primarily shale oil 30 and water 32, produced during operation of the retort collect in a portion of the production level drift 20 at the bottom of the fragmented mass 12. An emulsion of the shale oil and water can also be found in the drift, however, for simplicity of exposition only a shale oil phase 30 and a water phase 32 are illustrated.

The production level drift 20 extends downwardly and laterally away from the throat 18 of the fragmented mass 12. Liquid in a lower portion of the drift 20 forms a liquid trap 33 for providing a seal against the passage of off gas from the drift to underground workings in gas communication with the drift on a side of the liquid trap opposite the fragmented mass. The liquid trap is formed by maintaining sufficient liquid in the production level drift 20 in contact with a roof of unfragmented formation 34 at the top of the drift such that liquid occupies the entire cross-sectional area of a portion of the drift. Liquid is impervious to gas flow and therefore forms a gas seal which inhibits the flow of gas through the drift from the fragmented mass past the portion of the drift completely occupied by the liquid. The liquid in the drift can come from water 32 and shale oil 30 which collect in the drift at the bottom of the fragmented mass during retorting operations. At least a portion of the water 32 in the drift can be added from external sources for starting retorting operations since a substantial time can elapse between the beginning of retorting and the first appearance of liquid products at the bottom of the retort. A gas seal is needed from the beginning of retorting.

FIG. 1 illustrates one embodimet of the invention wherein the lengthwise extent of the production level drift 20 is generally U-shaped. A first or inner leg 36 of the U extends downwardly and outwardly from the throat 18 of the fragmented mass. The first leg 36 extends downwardly to a bottom portion 38 of the U at the floor of the drift. A second or outer leg 40 of the U extends laterally and upwardly from the bottom portion 38 of the U and away from the first leg 36. The liquid in the production level drift 20 forms a U-tube liquid trap wherein such liquid is maintained in contact at least with a lowermost portion 42 of unfragmented formation at the bottom of a brow 44 of unfragmented formation forming the roof of the drift. The brow of unfragmented formation extends lower than an adjacent portion of the roof of the drift. The liquid in the drift is in contact with a portion of a drift floor of unfragmented formation which is spaced from a bottom of the U and which has an elevation above that of the lowermost portion 42 of unfragmented formation at the roof of the drift. Alternatively, liquid retaining walls can be used to maintain sufficient depth of liquid in the the drift to seal against the roof of the drift. Thus, a liquid level is maintained across the cross-sectional area of the drift, which forms a gas impervious seal for sealing against the passage of off gas from the first leg to the second leg of the drift.

In the embodiment shown in FIG. 1, the liquid in the water trap 33 extends into the first leg 36 of the drift and into contact with a wall of unfragmented formation surrounding the first leg of the drift. The liquid also is maintained in contact with an elongated portion of the wall surrounding the second leg 40 of the drift. This provides an elongated portion of the drift having its entire cross-sectional area occupied by the liquid in the drift, which provides an effective seal against passage of gas through the drift. By providing a gas seal by liquid along an appreciable length of the drift, fugitive gas leakage through cracks or fissures in the unfragmented formation is minimized. Long gas communication paths through the unfragmented formation are not common and many of these can be sealed by liquid from the trap.

In the embodiment shown in FIG. 1, water occupies the first and second legs of drift, and shale oil collects above the water in the first leg of the drift as liquid products percolate down through the fragmented mass in the retort.

An upright retaining wall 46 is installed at an end of the second leg 40 of the drift farthest from the fragmented mass. The retaining wall 46 provides lateral support for liquid in the liquid trap. Although the U-shaped drift can be formed in such a way to provide a liquid trap without such a retaining wall, it is preferred to use the retaining wall since the second leg of the drift can be excavated at a shallower angle when such upright retaining wall is used, when compared with a drift of the same length not having such a retaining wall. A side of the retaining wall opposite the liquid trap can be laterally supported by an upright wall 48 of unfragmented formation or by backfill.

The retaining wall occupies only a portion of the cross-sectional area of the drift and does not require a gas tight seal with the walls of the drift for anchoring it in place in the drift. At least a portion of the retaining wall extends to a level above that of the lowermost portion 42 of the brow 44 of unfragmented formation above the drift. Thus, liquid supported by the retaining wall can be in contact with an elongated extent of the drift, and can be in contact with walls of unfragmented formation surrounding portions of the first leg 36 and the second leg 40 of the drift.

In one embodiment, the second leg of the drift extends to the retaining wall along an angle of inclination of between about 10°–15° relative to a horizontal plane. Such an angle of inclination is sufficiently shallow to allow the production level drift to be excavated using conventional mining equipment, such as standard gathering arm loaders with extendable rear conveyors.

The end of the second leg of the drift farthest from the fragmented mass opens into an elongated product withdrawal region 50 of the drift which extends generally horizontally away from the fragmented mass. A portion of product withdrawal region 50 of the drift is above an upper level 52 of the liquid maintained in contact with the retaining wall 46. The product withdrawal region extends generally horizontally from the liquid trap to adjacent underground workings. Liquid and gaseous products recovered from the bottom of the fragmented mass are withdrawn through the product withdrawal region of the drift 20.

An elongated, generally horizontally extending off gas passage 54 is bored through the brow 44 of unfragmented formation above the lengthwise extent of the production level drift. An elongated off gas withdrawal pipe 56 is secured in the passage 54. The off gas withdrawal pipe has an inner end 58 which opens into a side of the first leg 36 of the U-shaped production level drift above an upper level of the shale oil which collects in the first leg of the drift. An off gas control valve 60 can be connected to a portion of the off gas withdrawal pipe 56 in the product withdrawal region of the drift. The inlet of a blower (not shown) can be connected to the the off gas withdrawal pipe for withdrawing off gas from above the shale oil in the first leg of the drift. The outlet of the blower can deliver such off gas to a recovery or disposal system (not shown).

Shale oil which collects in the first leg of the production level drift is withdrawn from the drift by an oil withdrawal line 62 which can extend through the same passage 54 in the brow 44 of unfragmented formation as the off gas withdrawal pipe 56. Alternatively, a separate shale oil withdrawal hole can be drilled through the brow directly into the region occupied by shale oil in the liquid trap. An inner end of the oil withdrawal line extends into a region in the first leg of the drift where the shale oil collects above the water present in the first leg of the drift. An outer portion of the shale oil withdrawal line 62 is located in the product withdrawal region 50 of the drift and is connected to an oil pump 66 for withdrawing shale oil through the oil withdrawal line 62.

A water withdrawal line 68 extends into a portion of the water located in the product withdrawal portion of the drift adjacent the retaining wall. A water pump 70 connected to the water withdrawal line 68 can be operated to withdraw water from the liquid trap. The water withdrawal line can be used to control the level of liquid in the drift. The water level adjacent the retaining wall can gradually rise as shale oil and water collect in the first leg 36 of the drift. Water can be periodically withdrawn through the water withdrawal line 68 to maintain the liquid level below the top of the retaining wall 46, but constantly in contact with the roof 34 of the drift for maintaining the gas seal. Shale oil can be periodically withdrawn from the first leg of the drift through the oil withdrawal line 62, which can lower the water level adjacent the retaining wall. Water level sensors or automatic controls can be used to ensure that the water level of the drift is constantly maintained in contact with at least a portion of the roof of the drift whenever the water level in the drift is being lowered. Alternatively, the withdrawal line inlets can be at an elevation higher than the lowest region 42 of the roof to assure that an excess of liquid cannot be withdrawn.

Thus, liquid in the U-shaped drift 20 provides a gas seal in a lower production level of an in situ oil shale retort.A sufficient depth of liquid can be constantly maintained in the drift during retorting operations so as to seal against the passage of off gas from the first leg 36 to the second leg 40 of the drift. The liquid is constantly maintained in contact with walls of unfragmented formation surrounding at least the bottom portion 42 of the U, i.e., a portion of the drift which is downstream of the first leg 36 of the drift where off gas is present. By providing such a liquid level in constant contact with an elongated wall portion of unfragmented formation surrounding the bottom of the U, an effective gas impervious seal is provided. The liquid in the drift is more impervious to gas flow than formation containing oil shale, and therefore provides a more effective gas-tight seal than formation forming a wall of a production level drift which is directly exposed to off gas in the drift.

The gas seal provided by the liquid trap 33 eliminates the need for a conventional bulkhead installed in a production level drift. The retaining wall 46 is less costly and simpler to construct than a bulkhead, and does not require special measures for sealing the periphery of the wall in the drift.

Figure 2:
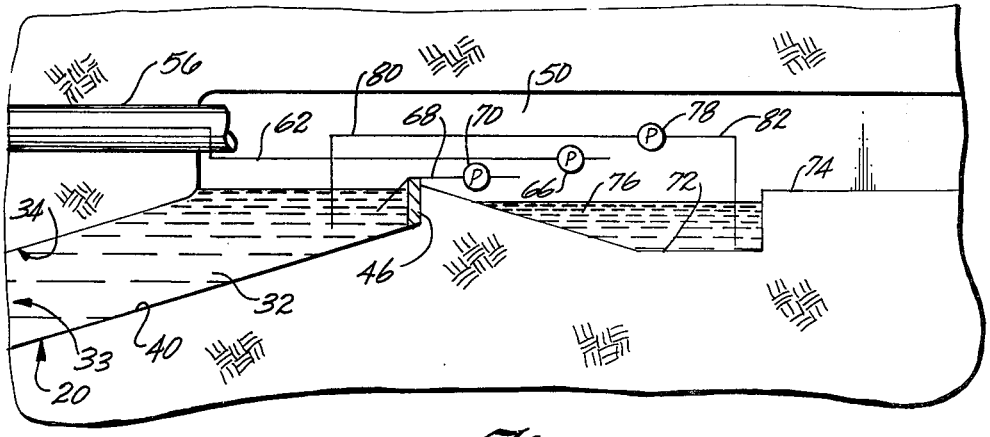
FIG. 2 is a fragmentary, semi-schematic, cross-sectional side view showing means for transferring liquid to and from a liquid trap shown in FIG. 1.

FIG. 2 shows a backup safety system for providing an auxiliary means for controlling the liquid level in the liquid trap 33. The backup safety system includes a sump 72 excavated in a floor 74 in the product withdrawal region 50 of the production level drift. The sump 72 is formed behind the retaining wall 46 (hereafter referred to as the first retaining wall), i.e., farther from the liquid trap 33 than the first retaining wall 46. A body of liquid 76, primarily water, is contained in the sump 72. Lateral support for the liquid 76 in the sump can be provided exclusively by walls of unfragmented formation surrounding the sump, or one or more upright retaining walls can be used to provide such lateral support.

During retorting operations, the level of the liquid in the liquid trap 33 can be controlled by operating the pump 70 to withdraw liquid through the water withdrawal line 68, as described above. If an excessive amount of liquid accumulates in the liquid trap, the liquid can overflow the first retaining wall 46 and be stored behind the liquid trap in the sump 72. If the level of the liquid in the liquid trap is reduced, and more liquid is needed in the liquid trap, the liquid in the sump 72 can be transferred to the liquid trap. A reversible pump 78 can be connected between a first water line 80 extending to the liquid trap 33 and a second water line 82 extending to the sump 72. The pump 78 can be operated to withdraw liquid from the sump 72 and transfer it to the liquid trap, or vice versa.

Figure 3:
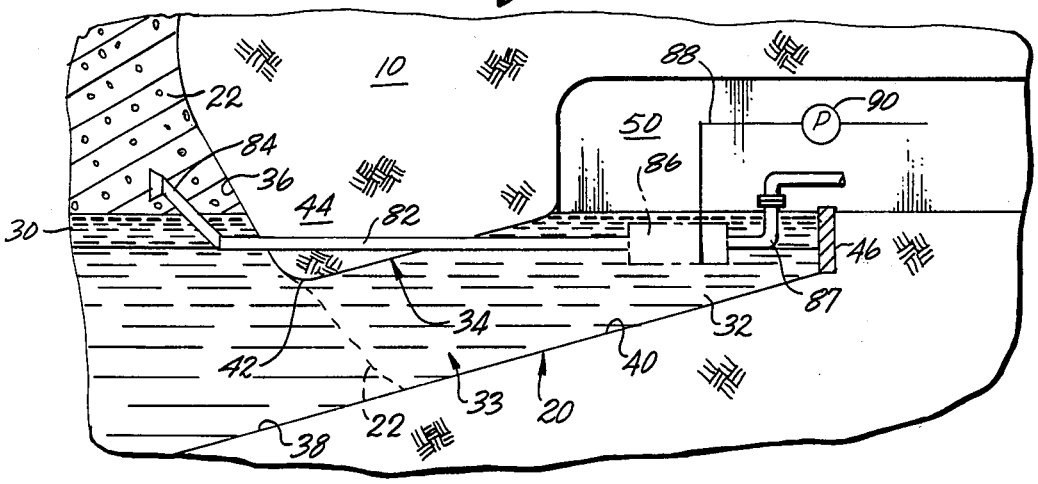
FIG. 3 is a fragmentary, semi-schematic, cross-sectional side view showing means for condensing liquid components of off gas withdrawn from the fragmented mass.
Figure 3:
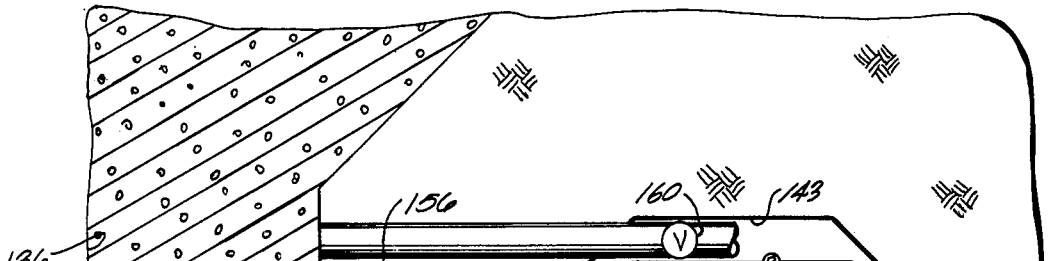

FIG. 3 shows an alternative system for withdrawing off gas from the first leg 36 of the U-shaped drift 20 above the shale oil 30. Such off gas can be withdrawn through an off gas withdrawal pipe 84 extending generally horizontally through a passage bored through the brow 44 of unfragmented formation above the liquid trap. An intake end 86 of the off gas withdrawal pipe 84 can extend upwardly into an upper region of the first leg of the drift for withdrawing off gas from above the shale oil 30. The off gas withdrawal pipe extends from the first leg of the drift through the water 32 in the second leg of the drift and to a heat exchanger 86 which is submerged in the water in the second leg 40 of the drift. The water 32 acts as a coolant for cooling off gas in the heat exchanger. The heat exchanger 86 can include a condenser (not shown) in which condensible components of the off gas can condense and collect before the non-condensed product gas is passed through the drift through an outer portion 87 of the off gas withdrawal pipe 84. The off gas entering in the condenser can contain up to about 35% water. By condensing out the water and other condensible liquids, the load on the blower for withdrawing the off gas can be substantially reduced. The liquid which collects in the heat exchanger can be withdrawn through a condensible withdrawal line 88 by a pump 90. Heat from off gas passing through the heat exchanger 86 also serves to warm liquid in the trap, thereby aiding in breaking any shale oil and water emulsion in the liquid trap.

FIG. 4 shows an alternative production level drift 120 according to principles of this invention. The alternative drift 120 need not be excavated along an angle of inclination to form a low region in the floor of the drift for holding water 132 in a liquid trap 133. Instead a retaining wall 146 is built in the drift 120 for retaining a sufficient depth of liquid in the trap to form a gas seal. In this form of the liquid trap, the production level drift 120 is formed as a U-tube having a first leg 136 in which shale oil 130 and water 132 accumulate at the bottom of a fragmented mass 112. The drift 120 extends below a brow 144 of unfragmented formation. A roof 134 of the drift at the brow 144 extends above the bottom portion of floor 138 of the drift, and liquid in the drift is sealed against the roof of the drift to provide a gas-tight seal against the passage of off gas from the first leg of the drift past the gas seal. The floor 138 of the drift extends into a second leg 140 of the U. The retaining wall 146 is mounted on the horizontal floor 138 in the second leg 140 of the drift. The roof in the second leg of the drift includes an upwardly extending recess or dome 143 above the retaining wall 146. Thus, the brow 144 of unfragmented formation adjacent the recess 143 protrudes downwardly toward the bottom or intermediate portion of the U-shaped trap. The retaining wall has a top portion at an elevation higher than the lowest part of the roof of the drift. Water 132 retained by the wall is maintained at a sufficient level in the recess 143 against the face of the retaining wall so that the water can be constantly maintained in contact with the roof of the drift, i.e., the bottom of the brow for providing the gas seal. Off gas can be withdrawn from the first leg 136 of the drift through an off gas withdrawal pipe 156 extending into the recess 143 of the drift. A valve 160 controls flow of gas through the off gas withdrawal pipe. Shale oil 130 can be withdrawn through an oil withdrawal line 162 similar to oil withdrawal line 62 shown in FIG. 1, and the liquid level in the water trap can be controlled by withdrawing liquid through a water withdrawal line 168 similar to water line 68 in FIG. 1.

What is claimed is:

1. An off gas seal for closing the bottom of an in situ oil shale retort containing a fragmented permeable mass of formation particles containing oil shale, the off gas seal comprising:

a drift extending laterally away from the fragmented mass, leaving a roof of unfragmented formation forming a top boundary of such a drift;

sufficient liquid in the drift to contact at least a portion of such a roof of unfragmented formation for forming a gas seal for inhibiting flow of gas from the fragmented mass through the drift past the gas seal;

a passage bored through unfragmented formation above the gas seal; and means extending through the passage for withdrawing off gas from the fragmented mass.

2. An off gas seal according to claim 1 including a retaining wall in the drift spaced from the portion of the roof forming the gas seal and located on a side of the gas seal opposite the fragmented mass for providing lateral support for the liquid in the drift.

3. An off gas seal according to claim 2 in which the retaining wall occupies less than the entire cross-sectional area of the drift.

4. An off gas seal according to claim 1 including means for adjusting the level of the liquid in the drift.

5. An off gas seal according to claim 1 including a sump in the drift spaced apart from the liquid forming the gas seal and located on a side of the gas seal opposite the fragmented mass; liquid in the sump; and pump means extending between the liquid in the sump and the liquid forming the gas seal for adjusting the level of the liquid forming the gas seal.

6. An off gas seal according to claim 1 including means for withdrawing shale oil from a portion of the drift in communication with the fragmented mass.

7. An off gas seal according to claim 6 including means for withdrawing liquid from a portion of the drift on the side of the gas seal opposite the fragmented mass.

8. An off gas seal for closing the bottom of an in situ oil shale retort containing a fragmented permeable mass of formation particles containing oil shale, the off gas seal comprising:

a drift extending laterally away from the fragmented mass, leaving a roof of unfragmented formation forming a top boundary of such a drift;

sufficient liquid in the drift to contact at least a portion of the roof of unfragmented formation for forming a gas seal for inhibiting flow of gas from the fragmented mass through the drift past the gas seal;

a sump in the drift spaced apart from the liquid forming the gas seal and located on a side of the gas seal opposite the fragmented mass;

liquid in the sump; and pump means extending between the liquid in the sump and the liquid forming the gas seal for adjusting the level of the liquid forming the gas seal, including means for transferring liquid to the sump from the portion of the drift forming the gas seal.

9. An off gas seal for closing the bottom of an in situ oil shale retort containing a fragmented permeable mass of formation particles containing oil shale, the off gas seal comprising:

a drift extending laterally away from the fragmented mass, leaving a roof of unfragmented formation forming a top boundary of such a drift;

sufficient liquid in the drift to contact at least a portion of the roof of unfragmented formation for forming a gas seal for inhibiting flow of gas from the fragmented mass through the drift past the gas seal;

a heat exchanger in the liquid forming the gas seal for condensing components of off gas withdrawn from the fragmented mass;

an off gas withdrawal line extending from the fragmented mass to the heat exchanger for delivering off gas to the heat exchanger;

means for withdrawing off gas from the heat exchanger; and means for withdrawing condensed components of the off gas from the heat exchanger.

10. An in situ oil shale retort formed in a subterranean formation containing oil shale, comprising:

a fragmented permeable mass of formation particles containing oil shale;

a generally U-shaped drift having a first leg in communication with the fragmented mass and a second leg in communication with adjacent underground workings;

sufficient liquid in a bottom portion of the U for providing a gas seal for inhibiting the flow of gas from the first leg to the second leg;

means in the second leg of the drift for withdrawing off gas from the first leg of the drift above the gas seal; and means in the second leg of the drift for withdrawing shale oil from the first leg of the drift above the gas seal.

11. A retort according to claim 10 in which the first leg extends into a lower portion of the fragmented mass, and liquid is maintained in the first leg in contact with a wall of unfragmented formation surrounding the first leg for providing the gas seal.

12. A retort according to claim 11 in which the second leg of the drift extends laterally away from the gas seal, and including a retaining wall in the second leg of the drift for maintaining the liquid in contact with the wall of unfragmented formation.

13. A retort according to claim 10 including a brow of unfragmented formation spaced above the bottom portion of the U, and including means for maintaining the liquid in contact with the brow of unfragmented formation to provide the gas seal.

14. A retort according to claim 13 including means extending through the brow of unfragmented formation for withdrawing off gas from the first leg of the drift.

15. A retort according to claim 13 in which the second leg of the drift extends laterally away from the gas seal; and including a retaining wall in the second leg of the drift for maintaining the liquid in contact with the brow of unfragmented formation.

16. A retort according to claim 10 including means for adjusting the level of the liquid in the drift.

17. An in situ oil shale retort formed in a subterranean formation containing oil shale, comprising:

a fragmented permeable mass of formation particles containing oil shale;

a generally U-shaped drift having a first leg in communication with the fragmented mass and a second leg in communication with adjacent underground workings;

sufficient liquid in a bottom portion of the U for providing a gas seal for inhibiting the flow of gas from the first leg to the second leg;

a sump in the second leg of the drift containing a supply of liquid; and means for transferring liquid between the sump and the liquid forming the gas seal.

18. An in situ oil shale retort formed in a subterranean formation containing oil shale, comprising:

a fragmented permeable mass of formation particles containing oil shale;

a generally U-shaped drift having a first leg in communication with the fragmented mass and a second leg in communication with adjacent underground workings;

sufficient liquid in a bottom portion of the U for providing a gas seal for inhibiting the flow of gas from the first leg to the second leg;

a retaining wall in the second leg of the drift providing lateral support for the liquid forming the gas seal;

a sump containing liquid in the second leg of the drift on a side of the retaining wall opposite the gas seal; and means for allowing the liquid which overflows the retaining wall to flow into the sump.

19. In an in situ oil shale retort formed in a subterranean formation containing oil shale and comprising a fragmented permeable mass of formation particles containing oil shale, inlet means for introducing gas into the top of the fragmented mass for establishing a retorting zone in the fragmented mass and for advancing the retorting zone in the fragmented mass, and outlet means at a lower portion of the fragmented mass for receiving liquid and gaseous products of retorting, improved means for providing a gas seal in the outlet means, comprising:

a generally U-shaped drift communicating with the lower portion of the fragmented mass, the U having a first portion communicating with the fragmented mass, a second portion extending laterally away from the fragmented mass and communicating with adjacent underground workings, and a roof of unfragmented formation at the bottom of the U between said first and second portions of the U, the second portion of the U having a floor having a portion spaced laterally from the bottom of the U and having an elevation above that of the roof at the bottom of the U;

sufficient liquid in the drift for forming a gas seal between the roof of the drift and said portion of the floor spaced from the bottom of the U;

means for withdrawing off gas from the lower portion of the fragmented mass to the second portion of the U on a side of the gas seal opposite the fragmented mass; and means for withdrawing shale oil from the lower portion of the fragmented mass to the second portion of the U on the side of the gas seal opposite the fragmented mass.

20. The improvement according to claim 19 including means for adjusting the level of the liquid in the drift.

21. In an in situ oil shale retort formed in a subterrnaean formation containing oil shale and comprising a fragmented permeable mass of formation particles containing oil shale, inlet means for introducing gas into the top of the fragmented mass for establishing a retorting zone in the fragmented mass and for advancing the retorting zone through the fragmented mass, and outlet means at the lower portion of the fragmented mass for receiving liquid and gaseous products of retorting, improved means for providing a gas seal in the outlet means, comprising:

a generally U-shaped drift communicating with the lower portion of the fragmented mass, the U having a first portion communicating with the fragmented mass, a second portion extending laterally away from the fragmented mass and communicating with adjacent underground workings, and a roof of unfragmented formation at the bottom of the U between said first and second portions of the U, the second portion of the U having a floor having a portion spaced laterally from the bottom of the U and having an elevation above that of the roof at the bottom of the U;

sufficient liquid in the drift for forming a gas seal between the roof of the drift and said portion of the floor spaced from the bottom of the U;

a retaining wall in the drift providing lateral support for the liquid to maintain the gas seal;

means for withdrawing off gas from the lower portion of the fragmented mass to the second portion of the drift on a side of the retaining wall opposite the fragmented mass; and means for withdrawing shale oil from the lower portion of the fragmented mass to the second portion of the drift on a side of the retaining wall opposite the fragmented mass.

22. The improvement according to claim 21 including means for withdrawing water from a portion of the drift on the side of the gas seal opposite the fragmented mass.

23. The improvement according to claim 21 wherein the retaining wall traverses only a portion of the cross-sectional area of the drift.

24. A method for sealing the bottom of an in situ oil shale retort containing a fragmented permeable mass of formation particles containing oil shale in a subterranean formation containing oil shale, the method comprising the steps of:

excavating a U-shaped drift having a first leg communicating with the lower portion of a fragmented mass in an in situ oil shale retort, the U-shaped drift having a second leg with a portion extending laterally away from the fragmented mass and communicating with adjacent underground workings;

establishing a retorting zone in the fragmented mass and advancing the retorting zone through the fragmented mass to generate liquid and gaseous products;

providing sufficient liquid in a bottom portion of the U and maintaining such liquid in contact with a roof of unfragmented formation above the bottom of the U for forming a gas seal for preventing flow of gaseous products from the first leg to the second leg of the U;

collecting the liquid and gaseous products in the first leg of the U-shaped drift;

withdrawing the gaseous products from the first leg past the gas seal to the portion of the second leg communicating with adjacent underground workings; and withdrawing the liquid products from the first leg past the gas seal to the portion of the second leg communicating with adjacent underground workings.

25. The method according to claim 24 including constantly maintaining water in contact with the roof of unfragmented formation for forming the gas seal.

26. A method for sealing the bottom of an in situ oil shale retort containing a fragmented permeable mass of formation particles containing oil shale in a subterranean formation containing oil shale, the method comprising the steps of:

excavating a U-shaped drift having a first leg communicating with the lower portion of a fragmented mass in an in situ oil shale retort, the U-shaped drift having a second leg communicating with adjacent underground workings;

establishing a retorting zone in the fragmented mass and advancing the retorting zone through the fragmented mass to generate liquid and gaseous products;

providing sufficient liquid in a bottom portion of the U and maintaining such liquid in contact with a roof of unfragmented formation above the bottom of the U for forming a gas seal for preventing flow of gaseous products from the first leg to the second leg of the U;

collecting the liquid products in the first leg of the U-shaped drift;

providing a heat exchanger in the liquid for condensing components of the gaseous products; and passing the gaseous products through the heat exchanger to condense liquid from the gaseous products in the heat exchanger.

27. A method for sealing the bottom of an in situ oil shale retort containing a fragmented permeable mass of formation particles containing oil shale in a subterranean formation containing oil shale, the method comprising the steps of:

excavating a drift extending laterally away from the fragmented mass, leaving a roof of unfragmented formation forming a top boundary of such a drift;

providing a retaining wall in the drift having a portion with an elevation higher than the elevation of the roof, said retaining wall being in a portion of the drift communicating with adjacent underground workings;

providing sufficient liquid in the drift in contact with the retaining wall so the liquid retained in the drift contacts at least a portion of the roof of unfragmented formation for forming a gas seal for preventing the flow of gas from the fragmented mass through the drift past the gas seal to the portion of the drift communicating with adjacent underground workings;

withdrawing off gas from the fragmented mass to a portion of the drift on a side of the retaining wall opposite the fragmented mass; and withdrawing shale oil from a portion of the drift communicating with the fragmented mass to a portion of the drift on the side of the retaining wall opposite the fragmented mass.

28. An off gas seal at the bottom of an in situ oil shale retort containing a fragmented permeable mass of formation particles containing oil shale in a subterranean formation containing oil shale, the gas seal comprising:

a drift extending laterally away from a bottom portion of the fragmented mass and including a roof portion of unfragmented formation;

means for retaining liquid in a portion of the drift adjacent such a roof portion, said portion of the drift communicating with adjacent underground workings;

sufficient liquid retained in said portion of the drift to form a gas seal against the roof portion to prevent gas flow through said portion of the drift; and means extending through unfragmented formation above the gas seal for withdrawing off gas from the fragmented mass past the gas seal to said portion of the drift communicating with adjacent underground workings.

29. An off gas seal according to claim 28 wherein the means for retaining liquid comprises a retaining wall in the drift, the wall having a top portion at an elevation higher than the lowest part of said roof portion for retaining a sufficient depth of liquid to contact said roof portion.

30. An off gas seal according to claim 28 including means for withdrawing shale oil from an upper portion of the liquid adjacent the fragmented mass past the gas seal to said portion of the drift.

31. An off gas seal at the bottom of an in situ oil shale retort containing a fragmented permeable mass of formation particles containing oil shale in a subterranean formation containing oil shale, the gas seal comprising:

a drift extending laterally away from a bottom portion of the fragmented mass and including a roof portion of unfragmented formation;

means for retaining liquid in a portion of the drift adjacent the roof portion;

sufficient liquid retained in said portion of the drift to seal against the roof portion and prevent gas flow through said portion of the drift;

means for withdrawing off gas from the fragmented mass;

wherein the means for retaining liquid comprises a generally U-shaped portion of the drift having a first leg in communication with the fragmented mass and a second leg in communication with underground workings, and wherein said roof portion comprises a brow of unfragmented formation extending lower than an adjacent portion of the drift; and wherein the means for withdrawing off gas comprises an off gas pipe extending through the brow of unfragmented formation.

32. An off gas seal according to claim 31 wherein said brow extends to a lower elevation than the floor in at least a portion of the second leg.

* * * * *